United States Patent [19]

Caperton

[11] 4,325,206

[45] Apr. 20, 1982

[54] GUIDE TUBE FOR SEWER RODDING MACHINE

[76] Inventor: Charles B. Caperton, P.O. Box 187, Spring Lake, N.J. 07762

[21] Appl. No.: 139,817

[22] Filed: Apr. 14, 1980

[51] Int. Cl.[3] ..... E04A 12/18

[52] U.S. Cl. ..... 52/108; 138/155; 254/134.3 FT

[58] Field of Search ..... 52/108; 138/155, 103; 254/134.3 FT

[56] References Cited

U.S. PATENT DOCUMENTS 3,805,462 4/1974 Caperton ..... 52/108

FOREIGN PATENT DOCUMENTS 1425887 12/1966 France ..... 52/108

*Primary Examiner*—John E. Murtagh

*Attorney, Agent, or Firm*—Paul & Paul

[57] ABSTRACT

A rigid multi-section split restraining tube is provided for use in manholes for containing the sewer rod, which is used in clearing sewer obstructions, and restraining it against the lateral reaction forces which are set up when the forwardly-driven axially-rotating sewer rod encounters an obstruction. The restraining tube is a series of short sections connected together by rigid links. Each section is split axially into upper and lower half sections, the lower half section being larger than the upper. The upper half section is adapted to be wound up on a reel or drum mounted on the rodding machine and stored. The lower half section, when withdrawn, may preferably be stored in an elongated U-shaped channel on the rodding machine. The upper half section is provided with a pair of lateral extending ears which are received within a pair of opposing curved slots in the sidewalls of the lower half section. The length of an ear in the axial direction may preferably be greater than the width of the curved slot at its narrowest point, thereby to additionally assure prevention of withdrawal of the ears from the slots and separation of the upper and lower interlocked sections in response to lateral forces tending to force separation of the sections.

7 Claims, 3 Drawing Figures

GUIDE TUBE FOR SEWER RODDING MACHINE

CROSS REFERENCE TO RELATED U.S. PATENTS

The restraining tube of the present application represents an improvement over the restraining tube shown in my U.S. Pat. No. 3,805,462, granted Apr. 23, 1974, on an application filed Feb. 22, 1973.

BACKGROUND OF THE INVENTION

This invention relates broadly to a restraining tube comprised of sectionalized longitudinally-split elongated rigid members adapted to be withdrawn and stored on a sewer rodding machine. When the tube is fed out and extended, a sewer rod is fed down through the tube into the manhole and into a sewer pipe which is to be cleared of obstruction.

The function of the restraining tube is to prevent movement and bending of the rod in a direction lateral to its axis in response to reaction forces which are set up when the forwardly driven axially-rotating sewer rod encounters an obstruction.

A restraining tube of the type which is the subject of the present application is shown and described in my aforesaid U.S. Pat. No. 3,805,462, and the description in my said patent is incorporated herein by reference.

SUMMARY OF THE INVENTION

A principal object of the present invention is to provide an improved restraining tube of the type shown in my U.S. Pat. No. 3,805,462.

The improvement of the present invention is achieved by providing each upper half section of the tube with a pair of laterally extending ears and providing each lower half section with a pair of opposed curved slots positioned to receive the projecting ears of the upper half section, thereby to interlock the upper and lower half sections. Once the upper and lower half sections are interlocked, the separation forces exerted against the upper and lower half sections by the sewer rod will be in directions lateral to the longitudinal axis of the rod and tube. The size, shape and position of the ears of the upper half section are so related to the size, shape and position of the slots of the lower half section that, as the upper and lower half sections are brought together from their separate storage positions, the ears enter the slots in an inclined position relative to the longitudinal axis of the tube. However, in their final interlocked position, the ears are parallel with the lengthwise axis of the tube. Thus in final interlocked position, the ears are prevented from being withdrawn from their respective slots by forces normal to the axis of the tube. This is achieved by the shape of the slot and by the fact that the width of the slot at its narrowest dimension is less than the length of the ear in the axial direction of the tube.

DETAILED DESCRIPTION OF THE PREFERRED EMBODIMENT

Figure 2:
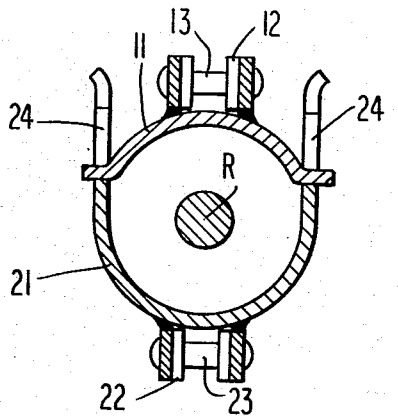
FIG. 2 is a view, in section, looking along the line 2—2 of FIG. 1 in the direction of the arrows.
Figure 1:
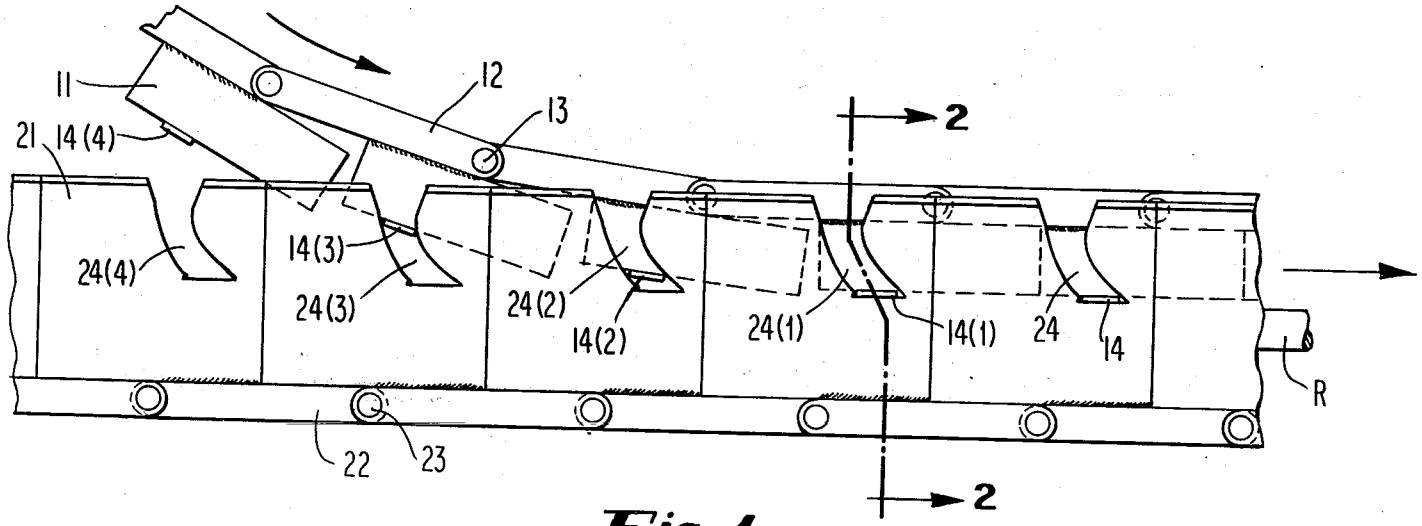
FIG. 1 is a side elevational view of a portion of a restraining tube which incorporates the present invention.

Referring now to FIGS. 1 and 2, there is shown a portion of a sectionalized split guide or restraining tube T. As seen in FIG. 1, and in cross section in FIG. 2, tube T is comprised of a plurality of short lengthwise sections each split axially into an upper half 11 and a lower half 21. Actually, the two halves 11 and 12 are not equal, the lower half 21 being larger than the upper half 11. Nevertheless, it will be convenient to refer to the upper and lower sections as "section halves" to avoid confusion with the short axial sections, each of which is split into an upper "section half" and a lower "section half". This term "section half" will also be used in the claims to refer to the upper and lower sections of a section.

The section halves 11 and 12 of each axial section are connected together by upper and lower connecting links, 12 and 22, respectively. Adjacent links are connected together by pins 13 and 23, respectively. The pins 13 of the upper links are staggered relative to the axial positions of the lower pins 23.

At each side of each upper section half 11 are a pair of ears 14 which extend laterally in opposing directions relative to the longitudinal axis of the tube T.

The opposing sides of each lower section half 21 extend upwardly to approximately the level of the upper connecting link 12, and provided in these upward extensions are curved slots 24 for receiving the opposing ears 14.

In my prior U.S. Pat. No. 3,805,462, the two halves of the sectionalized axially-split guide tube were stored on separate reels or drums. In a presently preferred machine, only the upper section half is stored on a reel or a drum. The lower section half is stored in an elongated U-shaped channel. In FIG. 1, the tube T is moving from left to right, as indicated by the arrow. The lower or bottom section halves 21 are being withdrawn from their elongated U-shaped storage channel (not shown) while the upper section halves 11 are being withdrawn from a storage drum or reel (not shown) located above the U-shaped storage channel at the exit thereof.

Figure 3:
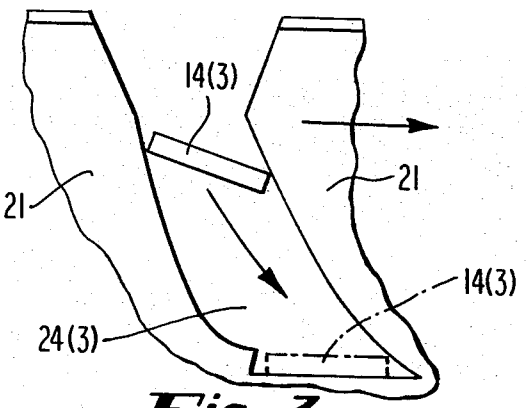
FIG. 3 is an enlarged view to illustrate that the ear enters through the most narrow dimension of the curved slot in an inclined or angular position, and that the width of the slot at its narrowest dimension is shorter than the length of the ear.

In the two leading or rightmost sections illustrated in FIG. 1, ears 14 and 14(1) have fully entered into their respective slots 24 and 24(1) and are lodged at the slot bottoms. Ears 14(2) of the next following section has not yet reached the bottom of its slot 24(2). It will be noticed that ear 24(2) is at a slight angle or inclination relative to the bottom of the slot 24(2). Ear 14(3) of the next following section is passing through the narrowmost point of slot 24(3). This situation is illustrated enlarged in FIG. 3 of the drawing. The width of slot 24(3) at its most narrow point is less than the length of ear 14(3) and passage of ear 14(3) through this most narrow point of slot 24(3) is dependent upon the fact that at the time of passage, the ear 14(3) is inclined at an angle relative to the base of the slot. It will be understood that this is true of each of the slots, and is not limited to slot 24(3) which happens to be illustrated.

In the last or leftmost of the sections illustrated in FIG. 1, ear 14(4) has not yet entered into the open mouth of slot 24(4) but will do so as the upper and lower half sections of tube T are drawn forwardly. The reference letter R identifies the sewer rod which is drawn through tube T and which is guided and restrained by the tube.

Once the upper and lower halves 11, 22, of an individual section are interlocked with ears 14 being at the bottom of the slots 24, separation of the upper and lower halves of a section, in response to forces exerted by rod R against the tube wall in directions normal or lateral to the lengthwise axis of the restraining tube T, is prevented by the fact that each ear 14, in response to such forces, cannot move upward in its respective slot 24, being prevented from doing so by the edge of the curved slot. In the unlikely event that there is some upward movement of an ear, further separation of the upper and lower halves of a section is prevented by the fact that the ear 14 cannot pass through the narrowmost point of the slot 24 for the reasons, as previously described, that the ear has a longer length than the narrowmost width of the slot and that the ear will not be disposed at an inclined angle as it was during entry into the slot. Rather, the ear is disposed parallel to the axis of the tube T in response to normal or lateral forces exerted by the rod R in a direction tending to push the two half sections apart.

In summary, the improvement provided by the present invention resides in the provision of a pair of ears which extend laterally from the sidewalls of each upper section half of the restraining tube, and a pair of curved slots in the sidewalls of each lower section half. When the upper sections halves of the tube are drawn from the storage reel or drum, each section half moves along a curved path on its way to merging with the lower section halves of the tube which are moving along a straight line path. As each upper section half approaches a lower section half, the upper section half, pivoting about its link-bar pivot pin, causes its pair of opposing ears to sweep through a relatively short arc and to enter the curved slots in the sidewall of the lower section half. The curvature of the edges of these slots corresponds to the curvature of the path along which the ears of the upper section half are moving modified by the forward movement of both the upper and lower section halves of the tube. The lowermost portion of the rearward edge of each slot is preferably vertical and straight for a distance approximately equal to that of the thickness of the ear. The purpose of the straight vertical portion of the rearward edge is to avoid having the ear cammed upwardly in the event a rearward axial force is impressed on the ear. Preferably, but not essentially, the narrowmost width of the curved slot is less than the length of the ear. This feature provides additional assurance against the upper and lower section halves being pulled apart in response to forces lateral to the axial length of the tube. The primary assurance against such separation is, however, provided by the rearward curvature of the forward edge of the slot.

What is claimed is:

1. A rigid restraining tube for restraining sewer rod and the like against reaction forces, said tube comprising:

a. a first series of axially short hollow section halves on one side of the longitudinal center axis of the tube;

b. a second series of complimentary axially short hollow section halves on the other side of said center axis;

c. first link bars pivotally connecting together the section halves of said first series;

d. second link bars pivotally connecting together the section halves of said second series;

e. each section half of said first series having a pair of opposed laterally-extending ears;

f. each section half of said second series having a pair of curved slots for receiving the ears of a complimentary section half of said first series;

g. said section halves of said second series being larger circumferentially than the section halves of said first series;

h. said section halves of said second series having tangentially extended sidewalls;

i. said slots being located in said extended sidewalls;

j. said slots having greater width at the mouth and at the bottom and smaller width at a point intermediate said mouth and bottom;

k. said smaller width being less than the length of an ear, whereby said ear may pass through said intermediate point of said slot only if it is disposed at an inclined angle relative to the longitudinal center axis of said tube.

2. Apparatus according to claim 1 wherein the ends of the section halves of the first series are aligned with the approximate center of the section halves of the second series.

3. Apparatus according to claim 2 wherein the link bars of said first series of section halves have pivot pins located in substantial alignment with the abutting ends of section halves of the second series.

4. Apparatus according to claim 3 wherein the link bars of the section halves of said second series have pivot pins located in approximate alignment with the abutting ends of the center halves of said first series.

5. Apparatus according to claim 3 wherein the link bars of the section halves of said first series are located at the axial center of said section halves and wherein said ears are located axially to one side of said axial center of said section halves.

6. A rigid restraining tube for restraining sewer rod and the like against reaction forces, said tube comprising:

a. a first series of axially short hollow section halves on one side of the longitudinal center axis of the tube;

b. a second series of complimentary axially short hollow section halves on the other side of said center axis;

c. first link bars pivotally connecting together the section halves of said first series;

d. second link bars pivotally connecting together the section halves of said second series;

e. each section half of said first series having a pair of opposed laterally-extending ears.

f. each section half of said second series having a pair of curved slots for receiving the ears of a complimentary section half of said first series;

g. the rearward edge of said curved slot being straight and vertical at its lower portion relative to the bottom edge of said slot.

7. A rigid restraining tube according to claim 6 wherein:

a. said section halves of said second series are larger circumferentially than the section halves of said first series;

b. said section halves of said second series have tangentially extended sidewalls;

c. said slots are located in said extended sidewalls.

* * * * *